United States Patent [19]

Kampf

[11] Patent Number: 4,512,529

[45] Date of Patent: Apr. 23, 1985

[54] WINDING MACHINE

[76] Inventor: Eberhard Kampf, Muehlener Strasse 44, 5276 Wiehl, Fed. Rep. of Germany

[21] Appl. No.: 507,551

[22] Filed: Jun. 24, 1983

[30] Foreign Application Priority Data

Jun. 25, 1982 [EP] European Pat. Off. ..... 82105629.8

[51] Int. Cl.[3] ..... B21C 47/02; B65H 79/00

[52] U.S. Cl. ..... 242/67.1 R; 242/68; 242/79

[58] Field of Search ..... 242/67.1 R, 68, 68.1, 242/68.4, 79, 80, 58.6

[56] References Cited

U.S. PATENT DOCUMENTS

| | | | |
|---|---|---|---|
| 1,491,200 | 4/1924 | Cline | 242/68.4 |
| 2,527,667 | 10/1950 | Wood | 242/79 |
| 3,052,422 | 9/1962 | Moser et al. | 242/68.4 |
| 3,603,521 | 9/1971 | Ormsby | 242/56.2 |
| 4,165,052 | 8/1979 | Seibert | 242/79 X |
| 4,265,411 | 5/1981 | Fasolak | 242/68.4 |

*Primary Examiner*—John Petrakes
*Assistant Examiner*—Lloyd D. Doigan
*Attorney, Agent, or Firm*—Bacon & Thomas

[57] ABSTRACT

A winding machine comprising individual slides cooperating in pairs and being movable on a slide guide and carrying pendulum arms which comprise a driving shaft positioned coaxially with respect to the swivel axis of the pendulum arms which is connected to a driving motor, and a receiver device driven by the driving shaft for the winding core. The technical problem of the invention resides in the adaptation of the driving moment to the winding tension required in each specific case. The pendulum arms are provided, for the optional equipment, with further driving motors. By adding additional winding motors it is possible to enlarge the winding tension range considerably. The winding motors, not used in a specific case, are parked on an extension rail out of the working width of the machine.

4 Claims, 5 Drawing Figures

WINDING MACHINE

BACKGROUND OF THE INVENTION

1. Field of the Invention

The invention relates to a winding machine comprising individual slides cooperating in pairs and being movable on a slide guide and carrying pendulum arms which comprise a driving shaft positioned coaxially with respect to the swivel axis of the pendulum arms, said driving shaft being connected to a driving motor, and a receiver device positioned at the ends of the pendulum arms driven by the driving shaft for the winding core.

2. Description of the Prior Art

A prior art winding machine of this type is provided for rolls without winding shaft, in that the winding core is clamped immediately between the receiver devices of a pair of pendulum arms. As a function of the strip-like material to be wound up, the thickness of the strip, the width of the roll, and of other parameters, the winding torque has a very different value. That means that the driving motor must be designed for the highest winding torque to be expected. That means an excessive expenditure of motor output, particularly due to the fact that electric motors become superproportional and expensive with increasing output.

SUMMARY OF THE INVENTION

It is the object of the invention to provide such a winding machine that by utilization of motors of limited medium output the winding torque may be easily adapted to the specific requirements within a large range.

According to the invention this object is solved in that the pendulum arms are provided with further driving motors to provide additional power, if required.

On the basis of this configuration, the pendulum arms are prepared to receive one, two or no driving motor. Consequently, a pair of swivel arms may be equipped with any number of driving motors between one motor and four driving motors. That means that the driving torque can be varied in the ratio 1:4. Consequently, it is possible to provide driving motors of comparatively small output which are at disposal at favourable costs. The driving motors are not of an excessive size which would necessitate special constructional measures.

The presuppositions for the optional connection of additional driving motors, for example, are provided in that the driving shaft is formed as a hollow shaft with internal toothing, and that the motor shaft with an external toothing engages the said internal toothing.

As a further development of the invention it is provided that the hollow driving shaft of each slide comprises receiver devices for a motor shaft on both front ends. By this configuration it is guaranteed that the driving motors can be coupled coaxially on both sides to the hollow driving shaft.

Furthermore, the invention provides that in each case a separate slide receives a driving motor with a motor shaft. This measure makes the handling of the driving motors easier.

Moreover, it is provided that the slide guide comprises an extension rail extending beyond the working width of the machine, on which rail the motor slides not used may be parked. Also the pundulum arms not required in a particular case may be parked on this extension rail out of the working width of the machine.

BRIEF DESCRIPTION OF THE DRAWINGS

One embodiment of the invention will be described in the following with reference to the drawings wherein.

DESCRIPTION OF THE PREFERRED EMBODIMENT

Figure 1:
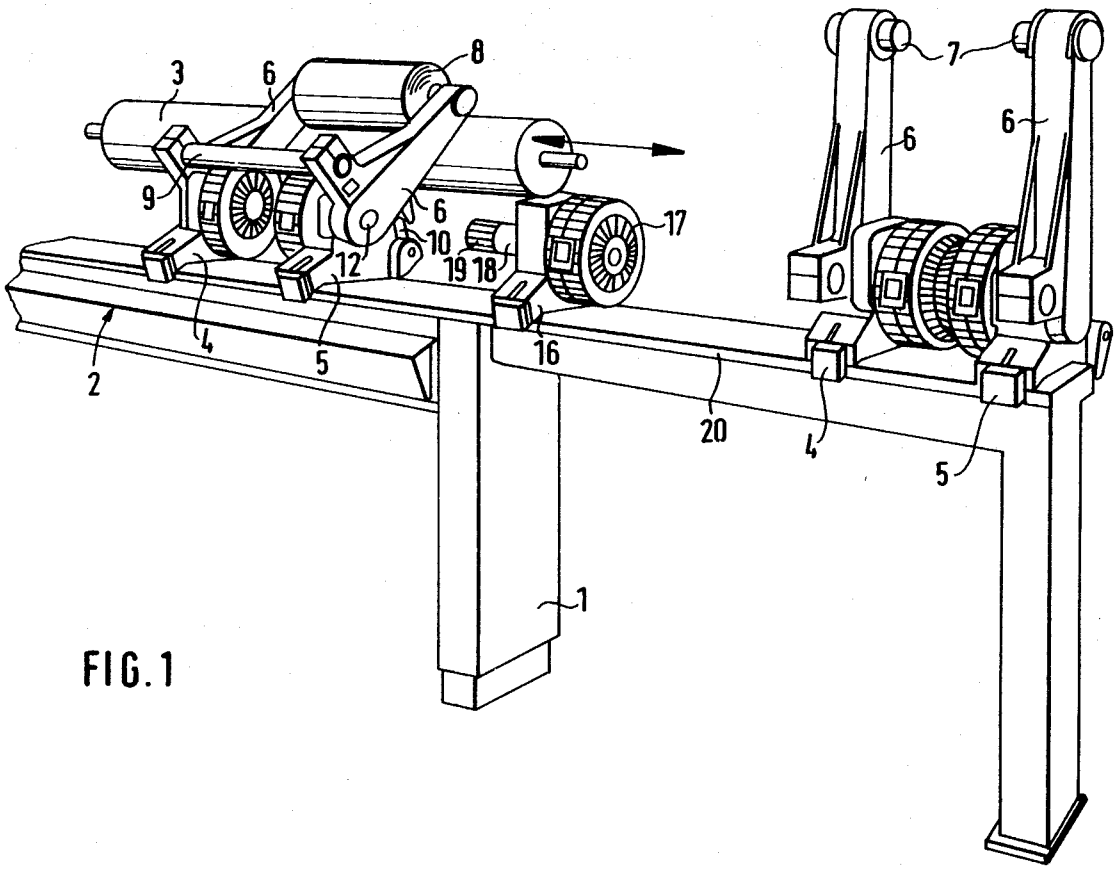
FIG. 1 is a perspective view of a winding machine according to the invention.

FIG. 1 shows a machine frame 1 with a slide guide 2. A contact roller is arranged in parallel with the slide guide, which contact roller 3 is supplied with the specific strip from a slitting station, not shown. On the slide guide in each case pairs of single slides 4, 5 are movable and lockable, each slide supporting a pendulum arm 6. Receiver devices 7 for a winding core with a roller 8 are provided at the ends of the pendulum arms 6. The winding core is held without a shaft between the receiver devices 7. The pendulum arms 6 are coupled with one another by a tie-bar 9 so that they can be swivelled with one another synchronously. The swivelling and adjustment of the contact pressure is performed by means of a pressure unit 10.

Figure 2:
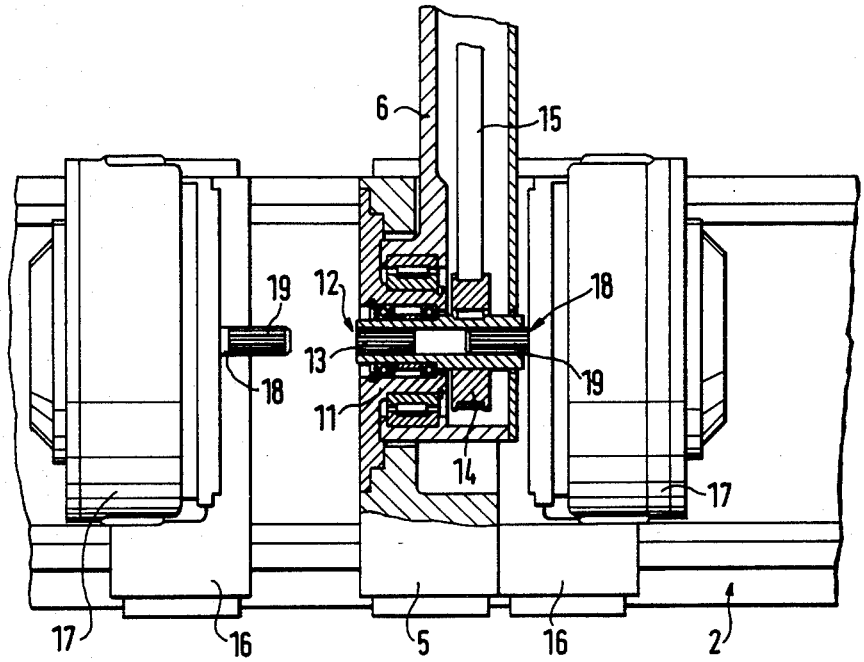
FIG. 2 is a plan view of the slide guide with pendulum arm.

Each pendulum arm 6 is swivelled on a hollow trunnion 11 of the indivudual slide 5. Within the hollow trunnion 11 a hollow driving shaft 12 with an internal toothing 13 is supported. The hollow driving shaft 12 carries a driving wheel 14 for a driving belt 15, which drives a shaft of the receiver device 7. The driving shaft 12 is open on both front ends, as it is clearly shown in FIG. 2.

On separate slides 16 a driving motor 17 is mounted, which has a driving shaft 18 with an external toothing 19. The motor shaft 18 is coaxially aligned in regard to the hollow driving shaft 12. Consequently, from both sides a motor shaft 18 may be plugged into the hollow driving shaft 12, as it is clearly shown in FIG. 2.

Figure 3:
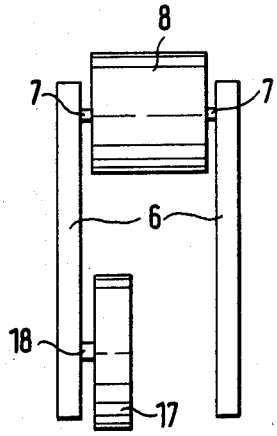
FIG. 3 is a schematic representation of a pair of pendulum arms with a driving motor.
Figure 4:
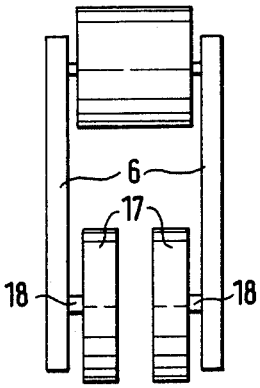
FIG. 4 is a corresponding representation of a pair of pendulum arms with two driving motors, whilst
Figure 5:
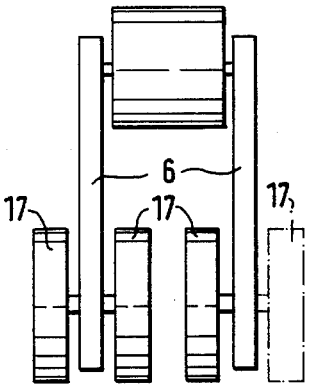
FIG. 5 is a corresponding representation of further modified quantities of driving motors.

According to the properties of the material to be wound, strip thickness, flexibility of the strip, winding width, different winding moment is required for the winding. According to FIGS. 3 to 5 one may provide for a strip which is to be wound with very low winding tension, just one driving motor according to FIG. 3. According to FIG. 2 one may also provide two driving motors, one driving motor for each pendulum arm. According to FIG. 5 one may equip each pendulum arm also with a second motor so that the number of driving motors may be varied from 1 to 4. In the schematic views of FIGS. 3 through 5 the slides are not shown.

In order to be able to permit additional driving motors with their additional slides, or pendulum arms which are not required for a given winding operation, the invention provides an extension rail 20 for the slide guide 2, which extension rail is adjacent to the slide guide 2 outside the working width of the machine. On this extension rail 20 individual slides 4, 5 with pendulum arms or additional slides for driving motors may be parked, if they are not required. Thus, this extension rail 20 can be used as a parking rail. The parked slides are ready for operation at any time and may be moved back on the slide guide to the working range of the machine and may be adjusted accordingly.

We claim the following:

1. A winding machine comprising:

(a) individual slides cooperating in pairs and being movable on a slide guide, (b) swivelable pendulum arms carried by said slide guides, each pendulum arm comprising:

(i) a hollow driving shaft positioned at one end of the pendulum arm coaxially with the swivel axis of the pendulum arm, and (ii) a receiver device at the other end of the pendulum arm adapted to be driven by the driving shaft;

(c) a motor for engaging one end of at least one of said hollow shafts, (d) a winding core carried by the receiver devices in two adjacent pendulum arms, (e) at least one additional motor for possible and selective connection to at least one of said hollow shafts.

2. A winding machine according to claim 1, wherein the hollow driving shaft comprises a hollow shaft with internal toothing and wherein the driving motor contains a projecting shaft with external toothing adapted to engage said internal toothing.

3. A winding machine according to claim 1, wherein said hollow driving shaft in the swivelable pendulum arm is adapted to be connected to driving motors on either side of the pendulum arm.

4. A winding machine according to any one of claims 1 through 3 wherein the slide guide comprises a rail of sufficient length to provide an area where slides may be parked when not in use.

* * * * *